US008451259B2

(12) United States Patent
Kim

(10) Patent No.: US 8,451,259 B2
(45) Date of Patent: May 28, 2013

(54) EMISSION DRIVER AND ORGANIC LIGHT EMITTING DISPLAY DEVICE INCLUDING THE SAME

(75) Inventor: Mi-Hae Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 775 days.

(21) Appl. No.: 12/636,686

(22) Filed: Dec. 11, 2009

(65) Prior Publication Data

US 2010/0207968 A1 Aug. 19, 2010

(30) Foreign Application Priority Data

Feb. 17, 2009 (KR) ..... 10-2009-0012809

(51) Int. Cl.
*G09G 3/14* (2006.01)
*G09G 5/10* (2006.01)

(52) U.S. Cl.
USPC ..... 345/206; 345/100

(58) Field of Classification Search
USPC ..... 345/42, 76, 80, 82, 100, 206; 377/64–81, 377/112–113
See application file for complete search history.

(56) References Cited

U.S. PATENT DOCUMENTS

| | | | | |
|---|---|---|---|---|
| 2004/0032926 | A1* | 2/2004 | Yu | 377/64 |
| 2005/0206637 | A1* | 9/2005 | Takahashi et al. | 345/204 |
| 2008/0150846 | A1* | 6/2008 | Chung | 345/80 |
| 2008/0165095 | A1* | 7/2008 | Jeon et al. | 345/76 |

FOREIGN PATENT DOCUMENTS

| | | | |
|---|---|---|---|
| KR | 10-0635500 | | 10/2006 |
| KR | 100646992 | B1 | 11/2006 |
| KR | 1020060112994 | A | 11/2006 |
| KR | 1020070048524 | A | 5/2007 |
| KR | 10-0858618 | B1 | 9/2008 |

OTHER PUBLICATIONS

KIPO Office action dated Sep. 30, 2010 in Korean priority application No. 10-2009-0012809.

* cited by examiner

*Primary Examiner* — Joseph Haley
*Assistant Examiner* — Andrew Sasinowski
(74) *Attorney, Agent, or Firm* — Christie, Parker & Hale, LLP

(57) ABSTRACT

An emission driver includes a plurality of stages, each including: a first driver for outputting an emission control signal through a corresponding emission control line in accordance with either the emission control signal and an inverse emission control signal output from a previous stage of the plurality of stages or a start signal and an inverse start signal; and a second driver for outputting an inverse emission control signal in accordance with the emission control signal and the inverse emission control signal output from the previous stage or the start signal and the inverse start signal, wherein odd numbered stages of the plurality of stages coupled to corresponding odd numbered emission control lines are configured to be driven by a first clock signal, and even numbered stages of the plurality of stages coupled to corresponding even numbered emission control lines are configured to be driven by a second clock signal.

14 Claims, 6 Drawing Sheets

EMISSION DRIVER AND ORGANIC LIGHT EMITTING DISPLAY DEVICE INCLUDING THE SAME

CROSS-REFERENCE TO RELATED APPLICATIONS

This application claims priority to and the benefit of Korean Patent Application No. 10-2009-0012809, filed on Feb. 17, 2009, in the Korean Intellectual Property Office, the entire content of which is incorporated herein by reference.

BACKGROUND

1. Field of the Invention

The present invention relates to an emission driver and an organic light emitting display device including the same.

2. Discussion of Related Art

Recently, various types of flat panel display devices have been developed having reduced weight and volume compared to cathode ray tubes. Such flat panel display devices include liquid crystal display (LCD) devices, field emission display (FED) devices, plasma display panels (PDPs), and organic light emitting display (OLED) devices, among others.

Among these flat panel display devices, the organic light emitting display device displays an image using organic light emitting diodes that emit light through the re-combination of electrons and holes. Such an organic light emitting display device has fast response times and is driven with low power consumption. A typical organic light emitting display device supplies current corresponding to data signals to organic light emitting diodes using transistors formed at each pixel, such that light is generated from the organic light emitting diodes.

Such a conventional organic light emitting display device includes a data driver that supplies data signals to data lines, a scan driver that supplies scan signals sequentially to scan lines, an emission driver that supplies emission control signals to emission control lines, and a display unit that includes a plurality of pixels coupled to the data lines, the scan lines and the emission control lines.

The pixels of the display unit are selected when the scan signals are supplied to the scan lines and receive the data signals from the data lines. The pixels receiving the respective data signals display an image by generating light having a predetermined brightness corresponding to the data signals. Here, the emission time of the pixels is controlled by the emission control signals supplied from the emission control lines. Generally, the emission control signals set the pixels supplied with the data signals to be in a non-light-emitting state, while overlapping with the scan signals supplied to one or two scan lines.

Recently, studies for optimally setting panel brightness corresponding to external light have been actively conducted. The panel brightness can be controlled using various methods. For example, the panel brightness can be controlled by adjusting bits of data corresponding to an amount of external light. However, a complicated process is involved to adjust the bits of data.

SUMMARY OF THE INVENTION

Accordingly, exemplary embodiments of the present invention provide an emission driver that can adjust the width of an emission control signal and an organic light emitting display device using the same.

According to an exemplary embodiment of the present invention, there is provided an emission driver including a plurality of stages, each of the plurality of stages including: a first driver for outputting an emission control signal through a corresponding emission control line in accordance with either the emission control signal and an inverse emission control signal output from a previous stage of the plurality of stages or a start signal and an inverse start signal; and a second driver for outputting an inverse emission control signal in accordance with the emission control signal and the inverse emission control signal output from the previous stage or the start signal and the inverse start signal, wherein odd numbered stages of the plurality of stages coupled to corresponding odd numbered emission control lines are configured to be driven by a first clock signal, and wherein even numbered stages of the plurality of stages coupled to corresponding even numbered emission control lines are configured to be driven by a second clock signal.

According to another exemplary embodiment of the present invention, there is provided an organic light emitting display device, including: a scan driver for supplying scan signals sequentially to scan lines; a data driver for supplying data signals to data lines; an emission driver for supplying emission control signals to emission control lines; and pixels positioned at crossing regions of the scan lines, the emission control lines and the data lines, wherein the emission driver includes a plurality of stages, each of the plurality of stages including: a first driver for outputting an emission control signal through a corresponding emission control line of the emission control lines in accordance with either the emission control signal and an inverse emission control signal output from a previous stage of the plurality of stages or a start signal and an inverse start signal; and a second driver for outputting an inverse emission control signal in accordance with the emission control signal and the inverse emission control signal output from the previous stage or the start signal and the inverse start signal, wherein odd numbered stages of the plurality of stages coupled to corresponding odd numbered emission control lines are configured to be driven by a first clock signal, and wherein even numbered stages of the plurality of stages coupled to corresponding even numbered emission control lines are configured to be driven by a second clock signal.

In an emission driver and an organic light emitting display device using the same according to exemplary embodiments of the present invention, the width of the emission control signal is adjusted according to the width of a start signal. Therefore, the width of the emission control signal can be adjusted as desired, and panel brightness can more readily be controlled.

BRIEF DESCRIPTION OF THE DRAWINGS

The accompanying drawings, together with the specification, illustrate exemplary embodiments of the present invention, and, together with the description, serve to explain the principles of embodiments of the present invention.

DETAILED DESCRIPTION OF EXEMPLARY EMBODIMENTS

Figure 1:
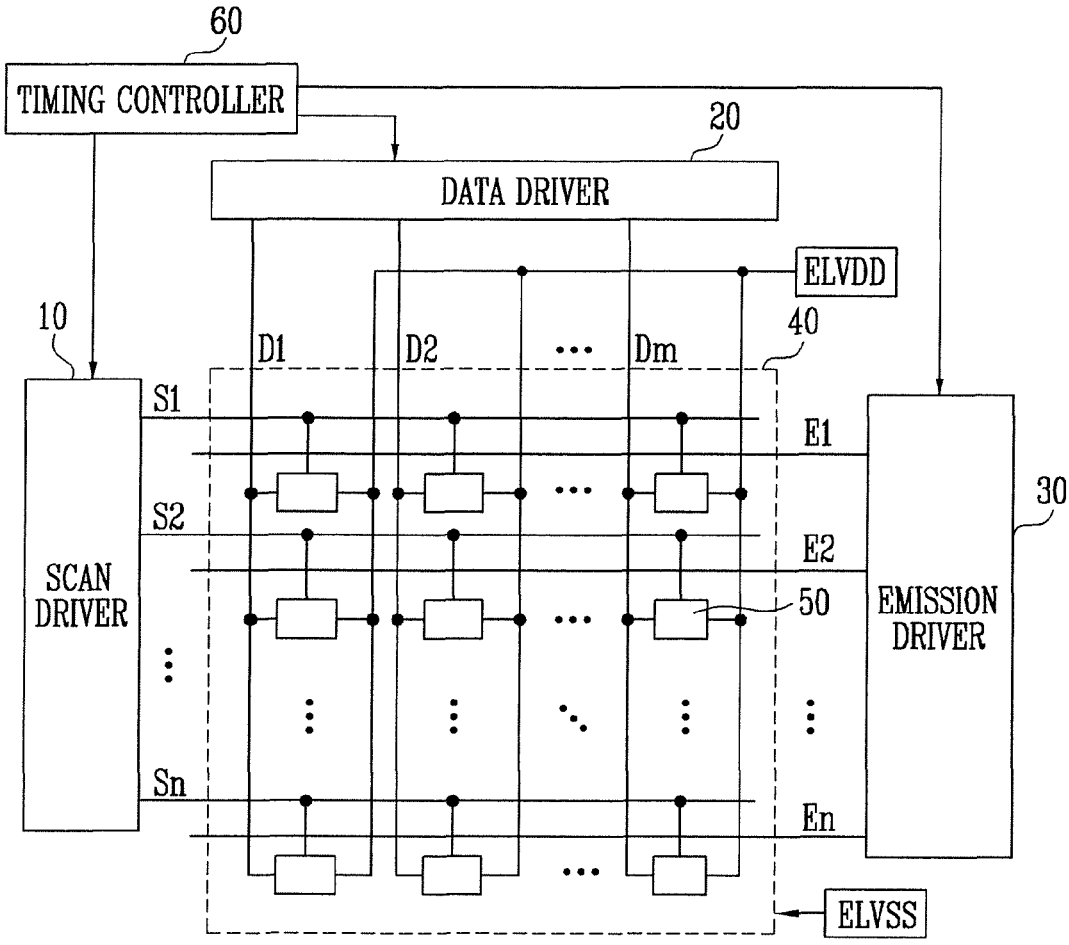
FIG. 1 schematically shows an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via one or more additional elements. Further, some of the elements that are not essential to the complete understanding of the invention are omitted for clarity. Also, like reference numerals refer to like elements throughout.

Hereinafter, exemplary embodiments according to the present invention will be described with reference to the accompanying FIGS. 1 to 6.

FIG. 1 schematically shows an organic light emitting display device according to an embodiment of the present invention. Although a scan driver 10 and an emission driver (or emission control driver) 30 are separated from each other in FIG. 1, the emission driver 30 may be included in the scan driver 10 in some embodiments.

Referring to FIG. 1, the organic light emitting display device according to an embodiment of the present invention includes a display unit 40 that includes a plurality of pixels 50 coupled to scan lines S1 to Sn, data lines D1 to Dm, and emission control lines E1 to En; the scan driver 10 for driving the scan lines S1 to Sn; a data driver 20 for driving the data lines D1 to Dm; the emission driver 30 for driving the emission control lines E1 to En; and a timing controller 60 for controlling the scan driver 10, the data driver 20, and the emission driver 30.

The scan driver 10 supplies scan signals sequentially to the scan lines S1 to Sn, and is controlled by the timing controller 60. Accordingly, the pixels 50 coupled to the scan lines S1 to Sn are selected sequentially.

The data driver 20 supplies data signals to the data lines D1 to Dm, and is also controlled by the timing controller 60. Here, the data driver supplies the data signals to the data lines D1 to Dm, when the scan signals are supplied. Then, the data signals are supplied to the pixels 50 selected by the scan signals, and each of the pixels 50 is supplied with a voltage corresponding to the data signal for the respective pixel to be charged thereto.

The emission driver 30 supplies the emission control signals sequentially to the emission control lines E1 to En, and is also controlled by the timing controller 60. The emission driver 30 supplies the emission control signals to the pixels 50 so that the pixels 50 do not emit light while the data signals are supplied to the pixels 50.

Here, a width of the emission control signal is controlled by a driving signal supplied from the timing controller 60.

Figure 2:
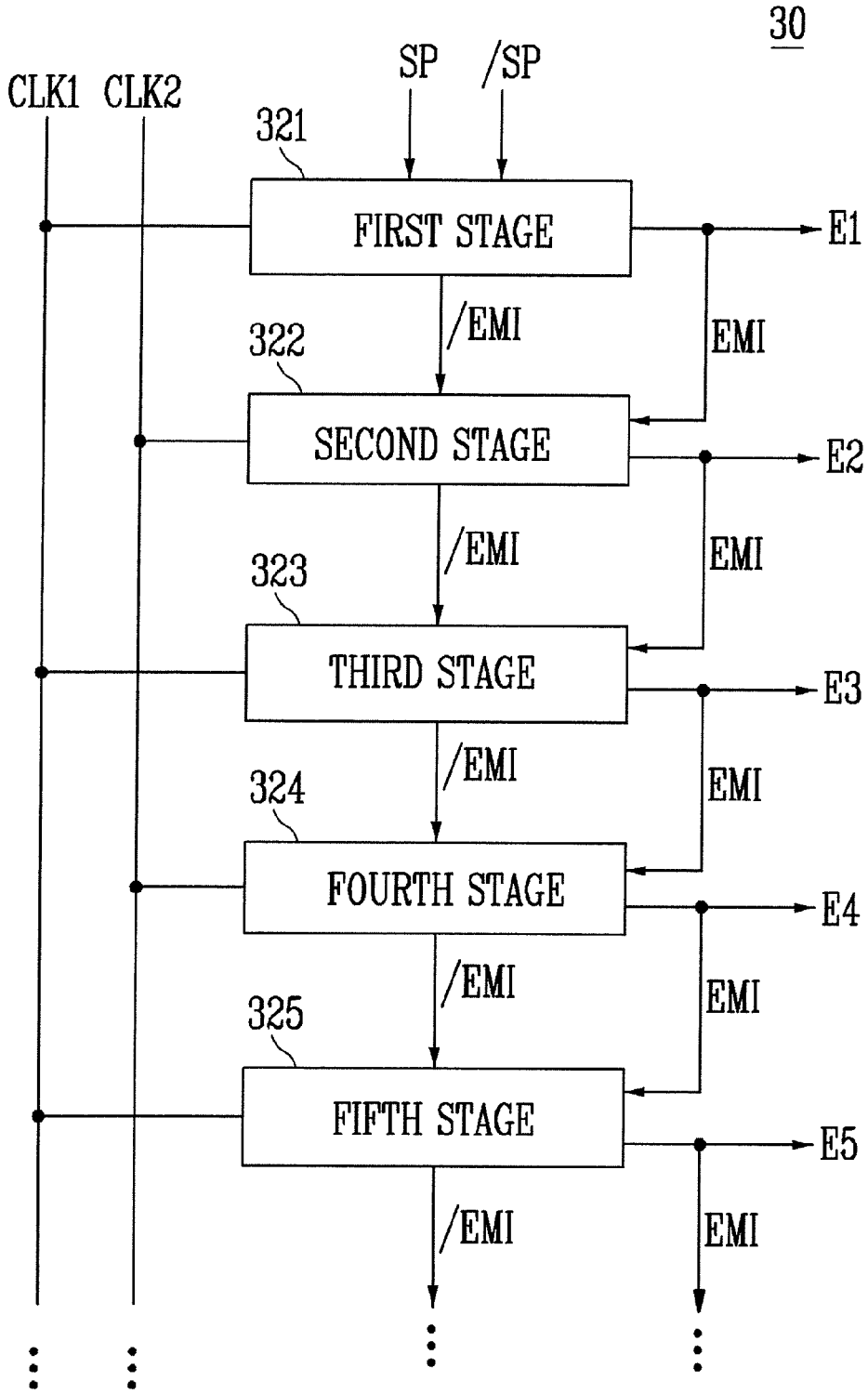
FIG. 2 schematically shows stages of the emission driver of FIG. 1.

FIG. 2 is a schematic view showing stages of the emission driver of FIG. 1.

Referring to FIG. 2, the emission driver 30 according to an embodiment of the present invention includes n stages 321, 322, 323, 324, 325, etc. that respectively supply the emission control signals to n emission control lines E1 to En. For convenience of illustration, five stages 321 to 325 are shown in FIG. 2. The respective stages 321 to 325 are coupled to the emission control lines E1 to E5, and are each driven by one clock signal.

More specifically, the timing controller 60 supplies two clock signals CLK1 and CLK2, a start signal SP, and an inverse start signal/SP to the emission driver 30. Here, the first clock signal CLK1 is supplied to odd number stages 321, 323, etc., and the second clock signal CLK2 is supplied to even number stages 322, 324, etc. The first clock signal CLK1 and the second clock signal CLK2 are set to have the same period but to have different supply times. For example, the second clock signal CLK2 may be offset from the first clock signal CLK1, having a phase delay of half a period compared to the first clock signal CLK1.

The first stage 321 is supplied with the start signal SP and the inverse start signal/SP and outputs an emission control signal EMI. Here, the width of the emission control signal EMI is determined by the width of the start signal SP. For example, the width of the emission control signal EMI may be set to be the same as the width of the start signal SP.

The first stage 321 supplies the emission control signal EMI and an inverse emission control signal/EMI to the second stage 322. The emission control signal EMI and the inverse emission control signal/EMI serve to perform substantially the same roles as the start signal SP and the inverse start signal/SP. Actually, an $i^{th}$ (i is a natural number) stage 32*i* supplies the emission control signal EMI and the inverse emission control signal/EMI for the $i^{th}$ stage to an $i+1^{st}$ stage 32*i*+1, so that a corresponding emission control signal EMI for the $i+i^{st}$ stage is subsequently generated from the $i+1^{st}$ stage 32*i*+1.

Meanwhile, the inverse start signal/SP is a signal that is the inverse of the start signal SP, and the inverse emission control signal/EMI is a signal that is the inverse of the emission control signal EMI. For example, if the start signal SP is set to have low voltage, high voltage is supplied to the inverse start signal/SP at the same time. Also, the emission control signal EMI is set to have high voltage and the inverse emission control signal/EMI is set to have low voltage at the same time.

Figure 3:
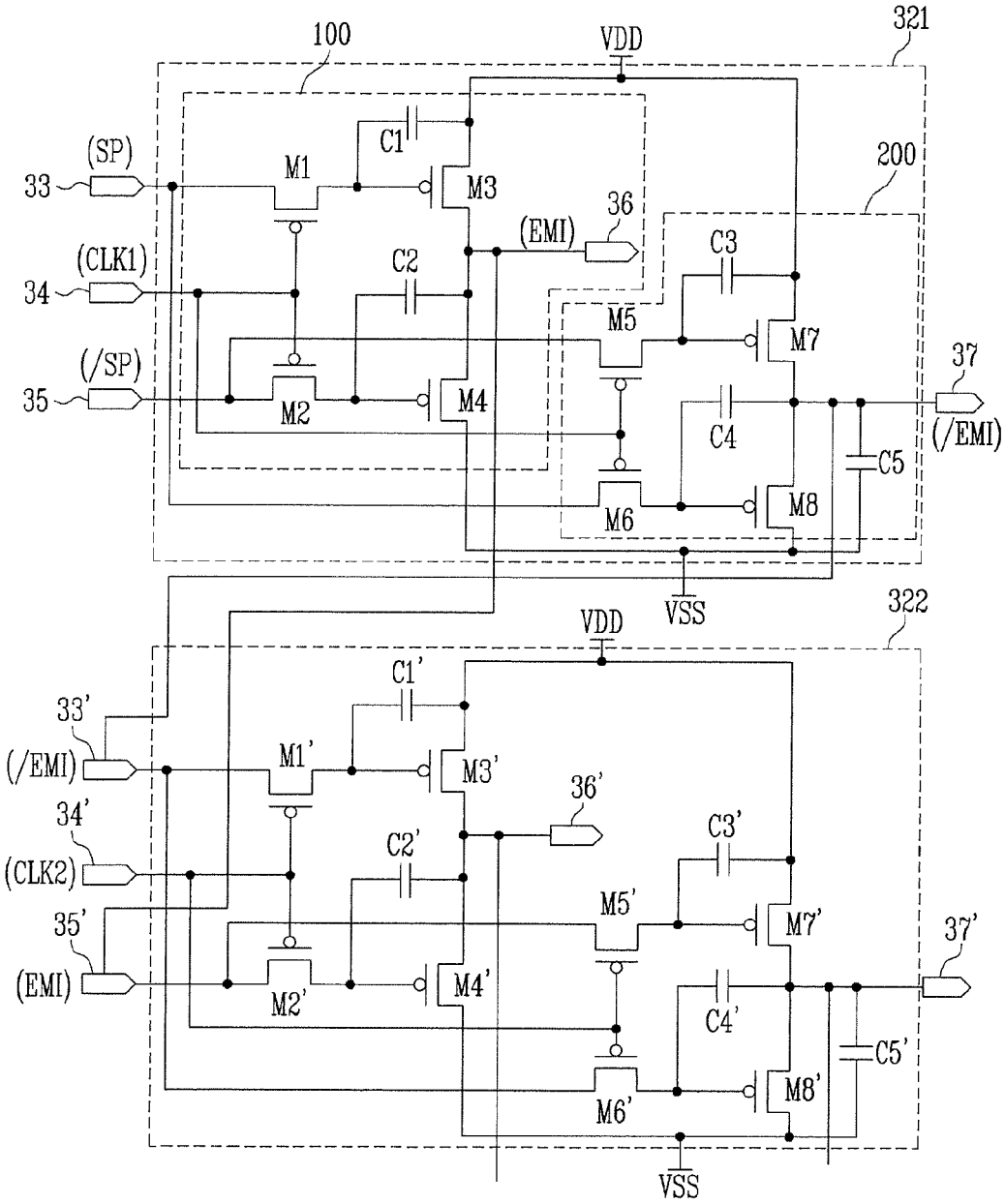
FIG. 3 shows a schematic circuit diagram of stages of FIG. 2.

FIG. 3 is a schematic circuit diagram showing stages of FIG. 2 in detail. For convenience of explanation, the first stage 321 and the second stage 322 will be shown in FIG. 3. Here, the first stage 321 and the second stage 322 have substantially the same circuit structure. Therefore, the circuit will be described with respect to the first stage 321.

Referring to FIG. 3, the first stage 321 according to the embodiment of the present invention includes a first driver 100 and a second driver 200.

The first driver 100 generates the emission control signal EMI using the start signal SP, the first clock signal CLK1 and the inverse start signal/SP. Here, the emission control signal EMI is supplied to a first emission control line E1 and the second stage 322. The first driver 100 includes first to fourth transistors M1 to M4, a first capacitor C1 and a second capacitor C2.

A first electrode of the first transistor M1 is coupled to a first input terminal 33, and a second electrode thereof is coupled to a gate electrode of the third transistor M3. A gate electrode of the first transistor M1 is coupled to a second input terminal 34. The first transistor M1 is turned on and turned off corresponding to a voltage supplied to the second input terminal 34. Here, the first input terminal 33 is supplied with the start signal SP, and the second input terminal 34 is supplied with the first clock signal CLK1.

A first electrode of the second transistor M2 is coupled to a third input terminal 35, and a second electrode thereof is coupled to a gate electrode of the fourth transistor M4. A gate electrode of the second transistor M2 is coupled to the second input terminal 34. The second transistor M2 is also turned on and turned off corresponding to the voltage supplied to the second input terminal 34. Here, the third input terminal 35 is supplied with the inverse start signal/SP.

A first electrode of the third transistor M3 is coupled to a first power supply VDD, and a second electrode thereof is coupled to a first output terminal 36. A gate electrode of the third transistor M3 is coupled to the second electrode of the first transistor M1. The third transistor M3 controls the coupling of the first power supply VDD to the first output terminal 36, being turned on and turned off corresponding to a voltage applied to the gate electrode of the third transistor M3. The first output terminal 36 is coupled to the emission control line E1 and outputs the voltage of the first power supply VDD as the emission control signal corresponding to the operation of the first driver 100.

A first electrode of the fourth transistor M4 is coupled to the first output terminal 36, and a second electrode thereof is coupled to a second power supply VSS. A gate electrode of the fourth transistor M4 is coupled to the second electrode of the second transistor M2. The fourth transistor M4 controls the coupling of the second power supply VSS to the first output terminal 36, being turned on and turned off corresponding to a voltage applied to the gate electrode of the fourth transistor M4. The output of the emission control signal is suspended (i.e., the emission control signal becomes low) when the second power supply VSS is supplied to the first output terminal 36.

Meanwhile, the second power supply VSS is set to have a lower voltage than the first power supply VDD. The first power supply VDD is supplied via a first power input terminal, and the second power supply VSS is supplied via a second power input terminal.

The first capacitor C1 is coupled between the gate electrode of the third transistor M3 and the first power supply VDD. The first capacitor C1 is charged with a voltage corresponding to the turning-on and turning-off of the third transistor M3. For example, when the third transistor M3 is turned on, the first capacitor C1 is charged with a voltage that turns on the third transistor M3, and when the third transistor M3 is turned off, the first capacitor is charged with a voltage that turns off the third transistor M3.

The second capacitor C2 is coupled between the gate electrode of the fourth transistor M4 and the first output terminal 36. The second capacitor C2 is charged with a voltage corresponding to the turning-on and turning-off of the fourth transistor M4.

The second driver 200 generates the inverse emission control signal/EMI using the start signal SP, the first clock signal CLK1 and the inverse start signal/SP. Here, the inverse emission control signal/EMI is supplied to the second stage 322. The second driver 200 includes fifth to eighth transistors M5 to M8, a third capacitor C3, a fourth capacitor C4, and a fifth capacitor C5.

A first electrode of the fifth transistor M5 is coupled to a third input terminal 35, and a second electrode thereof is coupled to a gate electrode of the seventh transistor M7. A gate electrode of the fifth transistor M5 is coupled to the second input terminal 34. The fifth transistor M5 is turned on and turned off corresponding to the voltage supplied to the second input terminal 34.

A first electrode of the sixth transistor M6 is coupled to the first input terminal 33, and a second electrode thereof is coupled to a gate electrode of the eighth transistor M8. A gate electrode of the sixth transistor M6 is coupled to the second input terminal 34. The sixth transistor M6 is also turned on and turned off corresponding to the voltage supplied to the second input terminal 34.

A first electrode of the seventh transistor M7 is coupled to the first power supply VDD, and a second electrode thereof is coupled to a second output terminal 37. A gate electrode of the seventh transistor M7 is coupled to the second electrode of the fifth transistor M5. The seventh transistor M7 controls the coupling of the first power supply VDD to the second output terminal 37, being turned on and turned off corresponding to a voltage applied to the gate electrode of the seventh transistor M3.

A first electrode of the eighth transistor M8 is coupled to the second output terminal 37, and a second electrode thereof is coupled to the second power supply VSS. A gate electrode of the eighth transistor M8 is coupled to the second electrode of the sixth transistor M6. The eighth transistor M8 controls the coupling of the second power supply VSS to the second output terminal 37, being turned on and turned off corresponding to a voltage applied to the gate electrode of the eighth transistor M8. Here, the inverse emission control signal/EMI is output (i.e., the inverse emission control signal EMI becomes low) while the second power supply VSS is coupled to the second output terminal 37.

The third capacitor C3 is coupled between the gate electrode of the seventh transistor M7 and the first power supply VDD to be charged with a voltage corresponding to the turn-on and turn-off of the seventh transistor M7.

The fourth capacitor C4 is coupled between the gate electrode of the eighth transistor M8 and the second output terminal 37 to be charged with a voltage corresponding to the turning-on and turning-off of the eighth transistor M8.

The fifth capacitor C5 is coupled between the second output terminal 37 and the second power supply VSS. The fifth capacitor C5 maintains the voltage of the second output terminal 37 irrespective of the clock signals.

Meanwhile, the second stage 322 (an even numbered stage) has substantially the same circuit structure as the first stage 321. The differences are that a first input terminal 33' of the second stage 322 is supplied with the inverse emission control signal/EMI of the previous stage (that is, the first stage), and a second input terminal 34' thereof is supplied with the second clock signal CLK2. The emission control signal EMI of the previous stage is supplied to a third input terminal 35' of the second stage 322. The configuration of the circuit and the operation process of the second stage are substantially the same as those of the first stage 321 except for the input associations, and thus a detailed description thereof will be omitted.

Figure 4:
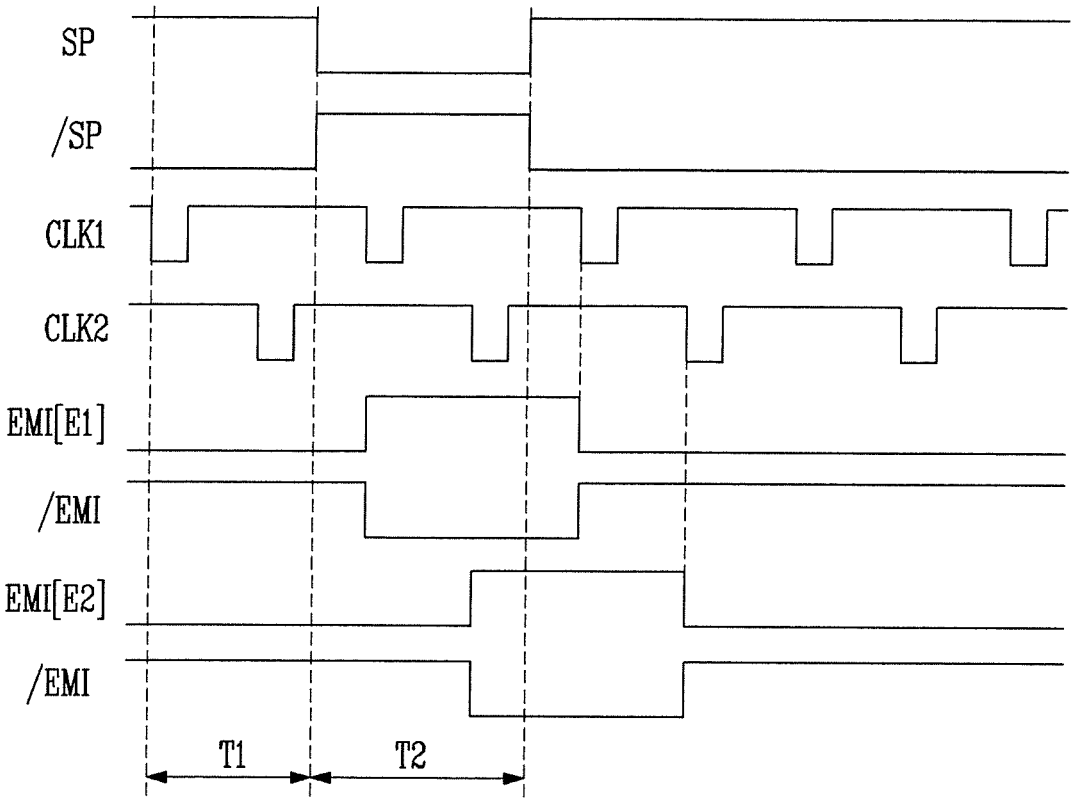
FIG. 4 is a waveform view showing a method of driving the circuit of the stages of FIG. 3.

FIG. 4 is a waveform view showing operation processes of the drivers shown in FIG. 3.

The operation processes will be described in more detail with reference to FIGS. 3 and 4. First, the start signal SP (e.g., low voltage) and the inverse start signal /SP (e.g., high voltage) are not supplied during a first period T1.

During the first period T1, the first transistor M1, the second transistor M2, the fifth transistor M5 and the sixth transistor M6 are turned on by the first clock signal CLK1.

When the first transistor M1 is turned on, the first input terminal 33 is coupled to the gate electrode of the third transistor M3. At this time, the start signal SP is not supplied to the first input terminal 33, i.e., a high voltage is supplied, so that the third transistor M3 is turned off.

When the second transistor M2 is turned on, the third input terminal 35 is coupled to the gate electrode of the fourth transistor M4. At this time, the inverse start signal/SP is not supplied to the third input terminal 35, i.e., a low voltage is supplied, so that the fourth transistor M4 is turned on. When the fourth transistor M4 is turned on, the second power supply VSS (e.g., low voltage) is supplied to the first output terminal 36. That is, the emission control signal EMI (e.g., high voltage) is not supplied to the first output terminal 36.

When the fifth transistor M5 is turned on, the third input terminal 35 is coupled to the gate electrode of the seventh transistor M7. At this time, the seventh transistor M7 is turned on so that the first power supply VDD (e.g., high voltage) is supplied to the second output terminal 37. That is, the inverse emission control signal /EMI (e.g., low voltage) is not supplied to the second output terminal 37.

If the sixth transistor M6 is turned on, the first input terminal 33 is coupled to the gate electrode of the eighth transistor M8. At this time, the eighth transistor M8 maintains a turn-off state.

Thereafter, the supply of the first clock signal CLK1 is stopped so that the first transistor M1, the second transistor M2, the fifth transistor M5 and the sixth transistor M6 are turned off. In this case, the fourth transistor M4 maintains a turn-on state by the voltage charged in the second capacitor C2, and the seventh transistor M7 maintains a turn-on state by the voltage charged in the third capacitor C3.

After the first clock signal CLK1 is supplied, the second clock signal CLK2 is supplied. During the first period T1 where the second clock signal CLK2 is supplied, a high voltage is supplied to the first input terminal 33' of the second stage 322 and a low voltage is supplied to the third input terminal 35' thereof. Therefore, the emission control signal EMI (e.g., high voltage) and the inverse emission control signal/EMI (e.g., low voltage) from the first stage 321 are not supplied to the first input terminal 36' and the second output terminal 37' of the second stage 322, respectively.

Thereafter, the start signal SP (e.g., low voltage) and the inverse start signal /SP (e.g., high voltage) are supplied during a second period. After the start signal SP and the inverse start signal/SP are supplied, the first clock signal CLK1 is supplied.

When the first clock signal CLK1 is supplied, the first transistor M1, the second transistor M2, the fifth transistor M5 and the sixth transistor M6 are turned on.

When the first transistor M1 is turned on, the start signal SP is supplied to the third transistor M3, and accordingly the third transistor M3 is turned on. When the third transistor M3 is turned on, the voltage of the first power supply VDD is supplied to the first output terminal 36. In other words, the emission control signal EMI (e.g., high voltage) is supplied to the first output terminal 36.

When the second transistor M2 is turned on, the inverse start signal/SP is supplied to the fourth transistor M4 and accordingly, the fourth transistor M4 is turned off.

When the fifth transistor M5 is turned on, the inverse start signal/SP is supplied to the seventh transistor M7 and accordingly, the seventh transistor M7 is turned off.

When the sixth transistor M6 is turned on, the start signal SP is supplied to the eighth transistor M8, and accordingly the eighth transistor M8 is turned on. When the eighth transistor M8 is turned on, the voltage of the second power supply VSS is supplied to the second output terminal 37. In other words, the inverse emission control signal/EMI (e.g., low voltage) is supplied to the second output terminal 37.

Thereafter, the supply of the first clock signal CLK1 is stopped so that the first transistor M1, the second transistor M2, the fifth transistor M5 and the sixth transistor M6 are turned off. In this case, the third transistor M3 maintains a turn-on state by the voltage charged in the first capacitor C1, and the eighth transistor maintains a turn-on state by the voltage charged in the fourth capacitor C4. Actually, the third transistor M3 and the eighth transistor M8 maintain a turn-on state during a period until a subsequent first clock signal CLK1 is supplied after the supply of the start signal SP and the inverse start signal/SP is stopped.

After the supply of the first clock signal CLK1 is stopped, the second clock signal CLK2 is supplied. During the second period where the second clock signal CLK2 is supplied, the inverse emission control signal/EMI (e.g., low voltage) from the first stage 321 is supplied to the first input terminal 33' of the second stage 322 and the emission control signal EMI (e.g., high voltage) from the first stage 321 is supplied to the third input terminal 35' thereof. Therefore, the emission control signal EMI and the inverse emission control signal/EMI from the first stage 321 are generated and output to the first output terminal 36' and the second output terminal 37' of the second stage 322, respectively.

The third transistor M3' and the eighth transistor M8' included in the second stage 322 output the emission control signal EMI (e.g., high voltage) and the inverse emission control signal/EMI (e.g., low voltage) of the second stage 322, maintaining a turn-on state during a period until a subsequent second clock signal CLK2 is supplied after the supply of the emission control signal EMI and the inverse emission control signal/EMI from the first stage 321 is stopped.

Meanwhile, the width of the emission control signal EMI of each stage according to an embodiment of the present invention is determined by the width of the start signal SP as described above. In other words, if the width of the start signal SP is set to be wide, the width of the emission control signal EMI of each stage is also set to be wide. Likewise, if the width of the start signal SP is set to be narrow, the width of the emission control signal EMI of each stage is also set to be narrow. Therefore, the present invention can adjust the width of the emission control signal EMI as desired, by controlling the width of the start signal SP supplied from the timing controller 60.

Figure 5:
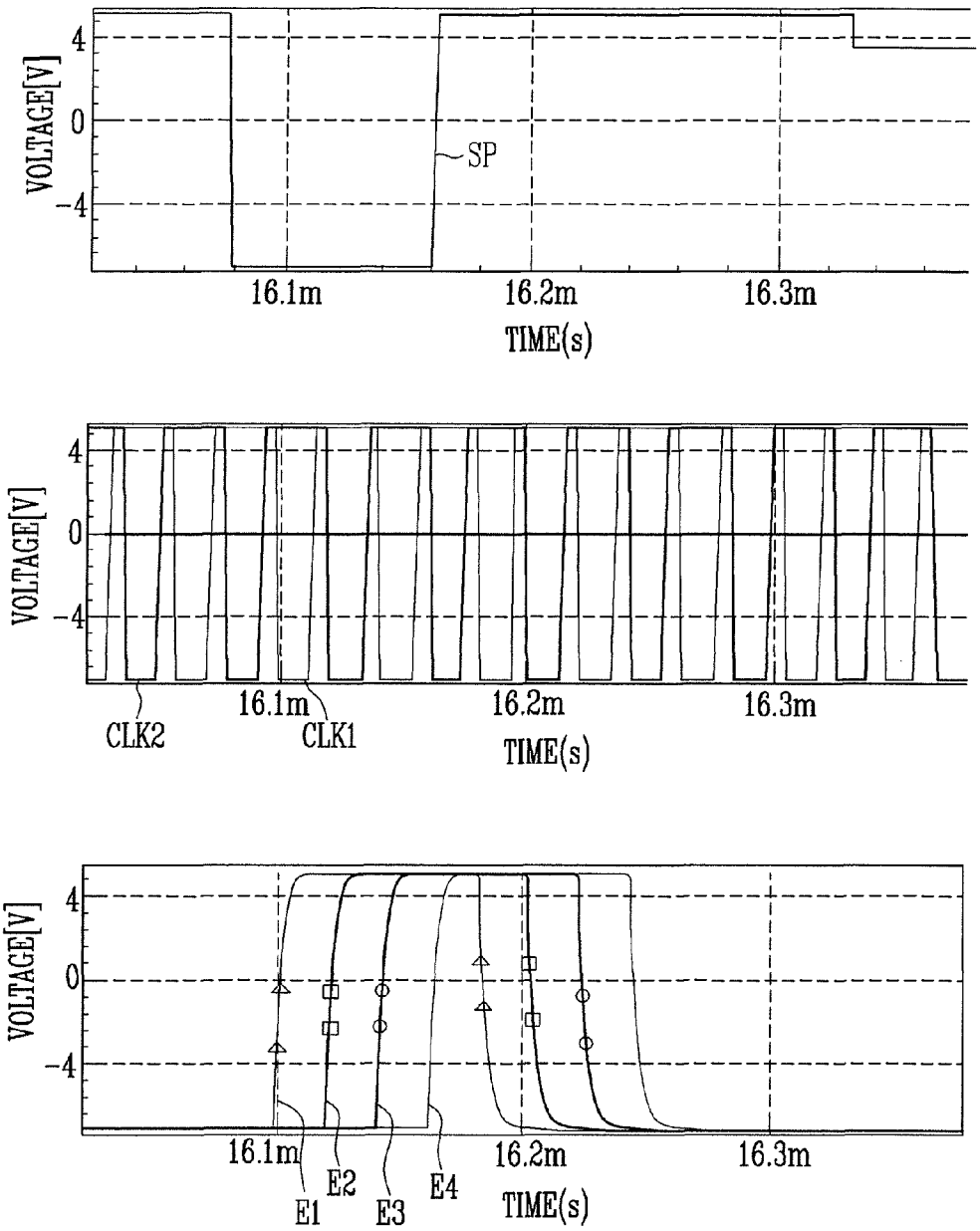
FIGS. 5 and 6 are waveform views showing simulation results of the circuit of the stages of FIG. 3.
Figure 6:
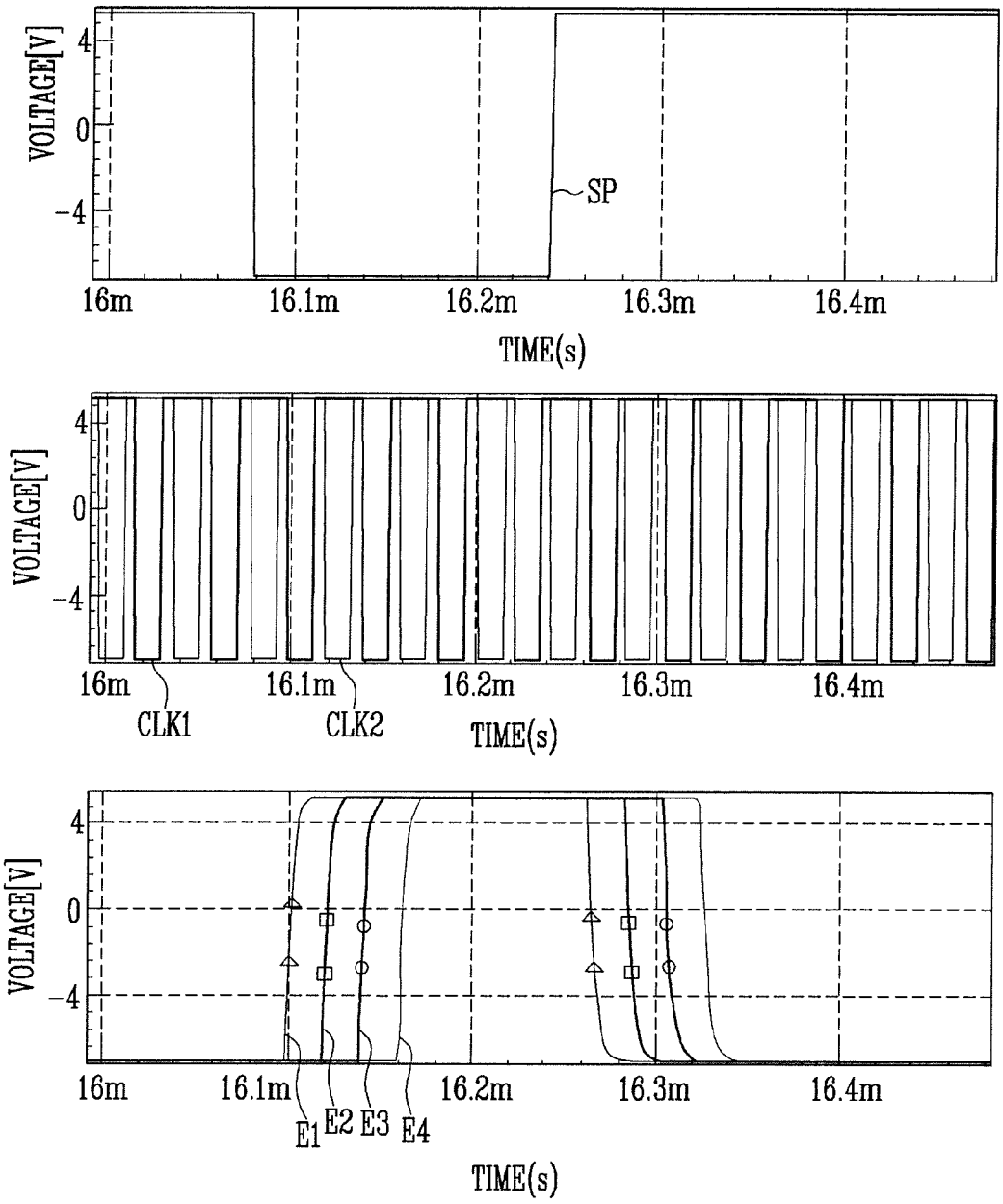

FIGS. 5 and 6 illustrate simulation results of circuits of the stages of FIG. 3.

FIG. 5 shows simulation results when the width of the start signal SP is set to 81.92 us and the first clock signal CLK1 and the second clock signal CLK2 are alternately supplied. In FIG. 5, the width of the emission control signals supplied to the emission control lines E1 to E4 is set to be the same (or similar) as the width of the start signal SP. In other words, it can be appreciated that the width of the emission control signal is determined by the width of the start signal SP.

FIG. 6 shows simulation results when the width of the start signal SP is set to 163.84 us and the first clock signal CLK1 and the second clock signal CLK2 are alternately supplied. In FIG. 6, the width of the emission control signal supplied to the emission control lines E1 to E4 is set to be similar (or the same) to the width of the start signal SP.

Meanwhile, the transistors in FIG. 3 are shown as PMOS transistors, but the present invention is not limited thereto. Alternatively, for example, the transistors in FIG. 3 may be formed as NMOS transistors. In this case, the voltage of the second power supply VSS is supplied to the first power input terminal, and the voltage of the first power supply VDD is supplied to the second power input terminal. The polarities of the clock signals and the start signals are inversed. The detailed driving processes other than the above are set to be substantially the same as those of the circuit in FIG. 3.

While the present invention has been described in connection with certain exemplary embodiments, it is to be understood that the invention is not limited to the disclosed embodiment, but is instead intended to cover various modifications and equivalent arrangements included within the spirit and scope of the appended claims, and equivalents thereof.

What is claimed is:

1. An emission driver comprising a plurality of stages, each of the plurality of stages comprising:

a first driver for outputting an emission control signal through a corresponding emission control line in accordance with either the emission control signal and an inverse emission control signal output from a previous stage of the plurality of stages or a start signal and an inverse start signal; and a second driver for outputting an inverse emission control signal in accordance with the emission control signal and the inverse emission control signal output from the previous stage or the start signal and the inverse start signal, wherein odd numbered stages of the plurality of stages coupled to corresponding odd numbered emission control lines are configured to be driven by a first clock signal, wherein even numbered stages of the plurality of stages coupled to corresponding even numbered emission control lines are configured to be driven by a second clock signal; and wherein the first driver comprises:

a first transistor having a first electrode coupled to a first input terminal and a gate electrode coupled to a second input terminal;

a second transistor having a first electrode coupled to a third input terminal and a gate electrode coupled to the second input terminal;

a third transistor having a first electrode coupled to a first power supply, a second electrode coupled to a first output terminal, and a gate electrode coupled to a second electrode of the first transistor;

a fourth transistor having a first electrode coupled to the first output terminal, a second electrode coupled to a second power supply, and a gate electrode coupled to a second electrode of the second transistor;

a first capacitor coupled between the gate electrode of the third transistor and the first power supply; and a second capacitor coupled between the gate electrode of the fourth transistor and the first output terminal.

2. The emission driver as claimed in claim 1, wherein the first clock signal and the second clock signal have a period having a same duration, and the second clock signal is offset from the first clock signal.

3. The emission driver as claimed in claim 2, wherein the second clock signal has a phase delay of half the period from the first clock signal.

4. The emission driver as claimed in claim 1, wherein a first stage of the plurality of stages is driven by the start signal and the inverse start signal, and each of the stages other than the first stage of the plurality of stages is driven by the emission control signal and the inverse emission control signal output from the respective previous stage of the plurality of stages.

5. The emission driver as claimed in claim 1, wherein in each of the odd numbered stages other than a first stage, the inverse emission control signal is supplied to the first input terminal of the stage from the respective previous stage, the first clock signal is supplied to the second input terminal of the stage, and the emission control signal is supplied to the third input terminal of the stage from the respective previous stage.

6. The emission driver as claimed in claim 1, wherein in each of the even numbered stages, the inverse emission control signal is supplied to the first input terminal of the stage from the respective previous stage, the second clock signal is supplied to the second input terminal of the stage, and the emission control signal is supplied to the third input terminal of the stage from the respective previous stage.

7. The emission driver as claimed in claim 1, wherein the start signal is supplied to the first input terminal of the first stage, the first clock signal is supplied to the second input terminal of the first stage, and the inverse start signal is supplied to the third input terminal of the first stage.

8. The emission driver as claimed in claim 1, wherein a first power is supplied from the first power supply, and a second power having a lower voltage than the first power is supplied from the second power supply.

9. The emission driver as claimed in claim 1, wherein a first power is supplied from the first power supply, and a second power having a higher voltage than the first power is supplied from the second power supply.

10. The emission driver as claimed in claim 1, wherein the second driver comprises:

a fifth transistor having a first electrode coupled to the third input terminal and a gate electrode coupled to the second input terminal;

a sixth transistor having a first electrode coupled to the first input terminal and a gate electrode coupled to the second input terminal;

a seventh transistor having a first electrode coupled to the first power supply, a second electrode coupled to a second output terminal, and a gate electrode coupled to a second electrode of the fifth transistor;

an eighth transistor having a first electrode coupled to the second output terminal, a second electrode coupled to the second power supply, and a gate electrode coupled to a second electrode of the sixth transistor;

a third capacitor coupled between the gate electrode of the seventh transistor and the first power supply; and a fourth capacitor coupled between the gate electrode of the eighth transistor and the second output terminal.

11. The emission driver as claimed in claim 10, further comprising a fifth capacitor coupled between the second output terminal and the second power supply.

12. An organic light emitting display device, comprising:

a scan driver for supplying scan signals sequentially to scan lines;

a data driver for supplying data signals to data lines;

an emission driver for supplying emission control signals to emission control lines; and pixels positioned at crossing regions of the scan lines, the emission control lines and the data lines, wherein the emission driver comprises a plurality of stages, each of the plurality of stages comprising:

a first driver for outputting an emission control signal through a corresponding emission control line of the emission control lines in accordance with either the emission control signal and an inverse emission control signal output from a previous stage of the plurality of stages or a start signal and an inverse start signal; and a second driver for outputting an inverse emission control signal in accordance with the emission control signal and the inverse emission control signal output from the previous stage or the start signal and the inverse start signal, wherein odd numbered stages of the plurality of stages coupled to corresponding odd numbered emission control lines are configured to be driven by a first clock signal, wherein even numbered stages of the plurality of stages coupled to corresponding even numbered emission control lines are configured to be driven by a second clock signal; and wherein the first driver comprises:

a first transistor having, a first electrode coupled to a first input terminal and a gate electrode coupled to a second input terminal;

a second transistor having a first electrode coupled to a third input terminal and a gate electrode coupled to the second input terminal;

a third transistor having a electrode coupled to a first power supply, a second electrode coupled to a first output terminal, and a gate electrode coupled to a second electrode of the first transistor;

a fourth transistor having a first electrode coupled to the first output terminal, a second electrode coupled to a second power supply, and a gate electrode coupled to a second electrode of the second transistor;

a first capacitor coupled between the gate electrode of the third transistor and the first power supply; and a second capacitor coupled between the gate electrode of the fourth transistor and the first output terminal.

13. The organic light emitting display device as claimed in claim 12, wherein the second driver comprises:

a fifth transistor having a first electrode coupled to the third input terminal and a gate electrode coupled to the second input terminal;

a sixth transistor having a first electrode coupled to the first input terminal and a gate electrode coupled to the second input terminal;

a seventh transistor having a first electrode coupled to the first power supply, a second electrode coupled to a second output terminal, and a gate electrode coupled to a second electrode of the fifth transistor;

an eighth transistor having a first electrode coupled to the second output terminal, a second electrode coupled to the second power supply, and a gate electrode coupled to a second electrode of the sixth transistor;

a third capacitor coupled between the gate electrode of the seventh transistor and the first power supply; and a fourth capacitor coupled between the gate electrode of the eighth transistor and the second output terminal.

14. The organic light emitting display device as claimed in claim 13, further comprising a fifth capacitor coupled between the second output terminal and the second power supply.

* * * * *

UNITED STATES PATENT AND TRADEMARK OFFICE

CERTIFICATE OF CORRECTION

PATENT NO. : 8,451,259 B2
APPLICATION NO. : 12/636686
DATED : May 28, 2013
INVENTOR(S) : Mi-Hae Kim

It is certified that error appears in the above-identified patent and that said Letters Patent is hereby corrected as shown below:

In the Claims

| | |
|---|---|
| Column 11, Claim 12, line 1 | Delete "having,"<br>Insert -- having -- |
| Column 11, Claim 12, line 7 | Before "electrode"<br>Insert -- first -- |

Signed and Sealed this
Fifteenth Day of July, 2014

Michelle K. Lee

Michelle K. Lee
*Deputy Director of the United States Patent and Trademark Office*